US009375097B2

(12) United States Patent
Stango et al.

(10) Patent No.: US 9,375,097 B2
(45) Date of Patent: Jun. 28, 2016

(54) CONVERTIBLE WALKER

(71) Applicant: KIDS II, INC., Atlanta, GA (US)

(72) Inventors: James Stango, Berwyn, PA (US); Aaron Flores, Atlanta, GA (US)

(73) Assignee: KIDS II, INC., Atlanta, GA (US)

( * ) Notice: Subject to any disclaimer, the term of this patent is extended or adjusted under 35 U.S.C. 154(b) by 0 days.

(21) Appl. No.: 14/300,787

(22) Filed: Jun. 10, 2014

(65) Prior Publication Data

US 2014/0370775 A1 Dec. 18, 2014

Related U.S. Application Data

(60) Provisional application No. 61/835,033, filed on Jun. 14, 2013.

(51) Int. Cl.
*A47D 13/04* (2006.01)
*A63G 19/18* (2006.01)

(52) U.S. Cl.
CPC ..... *A47D 13/043* (2013.01); *A63G 19/18* (2013.01)

(58) Field of Classification Search
CPC ..... A63G 17/00; A47D 13/043
USPC ..... 446/29
See application file for complete search history.

(56) References Cited

U.S. PATENT DOCUMENTS 2,651,881 A 9/1953 Glass et al.
3,012,364 A 12/1961 Johnson
3,230,662 A 1/1966 Fuchs
3,264,782 A 8/1966 Glass et al.
3,523,385 A 8/1970 Noble
3,903,638 A 9/1975 Comber
4,078,330 A 3/1978 Roth
4,079,957 A 3/1978 Blease
4,098,517 A 7/1978 Sortini
4,262,443 A 4/1981 Ferris et al.
4,264,080 A 4/1981 Kassai
4,572,530 A 2/1986 Marino
4,741,544 A 5/1988 Kassai
4,895,379 A 1/1990 Kelly
4,958,842 A 9/1990 Chang
5,335,917 A 8/1994 Kuna
D371,812 S 7/1996 Veraguth
5,692,944 A 12/1997 Pellicone
6,089,586 A 7/2000 Rudell et al.
6,296,268 B1 * 10/2001 Ford et al. ..... 280/648
6,485,349 B1 11/2002 Snyder et al.
6,719,310 B1 4/2004 Lin
6,991,242 B2 1/2006 Teng et al.
7,455,308 B2 11/2008 Michelau et al.
(Continued)

*Primary Examiner* — Jeffrey Vanderveen
(74) *Attorney, Agent, or Firm* — Gardner Groff Greenwald & Villanueva, PC

(57) ABSTRACT

A convertible walker/rider includes a frame and a seat assembly, and is convertible between a riding mode and a walking mode. The frame includes a pair of substantially horizontally oriented base legs and an upright portion coupled to and extending generally upwardly from the base legs. The seat assembly is pivotally mounted to the upright portion and includes a seat platform, a pair of seat support legs generally extending from the seat platform, and a seat handle extending between the seat support legs. The seat assembly is positionable in either a seated position for operating the convertible walker in a riding mode or in an upright position for operating the convertible walker in a walking mode. The base legs can be selectively adjustable to widen or lessen the distance therebetween.

29 Claims, 8 Drawing Sheets

(56) References Cited

U.S. PATENT DOCUMENTS

| | | | | |
|---|---|---|---|---|
| 7,878,522 | B2 | 2/2011 | Liao | |
| 8,500,134 | B2 | 8/2013 | Tzoreff | |
| 8,517,403 | B2 * | 8/2013 | Jessie, Jr. | 280/87.041 |
| 8,740,236 | B2 | 6/2014 | Ouboter | |
| 2002/0000702 | A1 | 1/2002 | Charron | |
| 2008/0179850 | A1 | 7/2008 | Catelli | |
| 2008/0191446 | A1 | 8/2008 | Chow | |
| 2011/0089656 | A1 | 4/2011 | Chiu et al. | |
| 2012/0171924 | A1 | 7/2012 | Karnick et al. | |
| 2014/0038792 | A1 * | 2/2014 | Farnsworth et al. | 482/112 |

* cited by examiner

CONVERTIBLE WALKER

CROSS-REFERENCE TO RELATED APPLICATION

This application claims the benefit of U.S. Provisional Patent Application Ser. No. 61/835,033 filed Jun. 14, 2013, the entirety of which is hereby incorporated herein by reference for all purposes.

TECHNICAL FIELD

The present invention relates generally to the field of children's toys and learning and exercise devices, and more particularly to a children's walker/rider that is convertible between a walking mode and a riding mode.

BACKGROUND

Walkers are commonly known for accelerating the development of walking skills of a toddler. Typically, the development of a child's walking skills is relatively short-lived since most children generally learn to walk over a relatively short span of time. Thus, walkers are only used for a certain period of time during the child's development, which makes the useful life span of the walker relatively short. Some walkers have been modified to provide for both the walking mode and a riding mode (i.e., supporting the child sitting thereon), but these walkers have been known to be bulky, inadequate and heavy, may require tools and/or difficult disassembly and reconfiguration, and often are not optimal for either walking or riding applications due to the structure required for facilitating modification between the two applications. It is to the provision of a convertible walker that is readily and easily convertible between a walking mode and a riding mode, without the need for tools or complex disassembly and reassembly, meeting these and other needs that the present invention is primarily directed.

SUMMARY

In example embodiments, the present invention provides a convertible walker/rider for children and toddlers that is readily and easily convertible between a walking mode and a riding mode, without the need for tools or complex disassembly and reassembly. In one aspect, the present invention relates to a convertible walker including a frame and a seat assembly. The frame includes a pair of substantially horizontally oriented base legs and an upright portion coupled to and extending generally upwardly from the base legs. The seat assembly is pivotally mounted to the upright portion and includes a seat platform, a pair of seat support legs generally extending from the seat platform, and a seat handle extending between the seat support legs. In example forms, the seat assembly is positionable in either a seated position for operating the convertible walker in a riding mode or in an upright position for operating the convertible walker in a walking mode. In one form, the base legs can be selectively adjustable to widen or lessen the distance therebetween.

In another aspect, the invention relates to a children's convertible walker that is convertible between a riding mode and a walking mode. The convertible walker includes a frame, a seat assembly, and a locking mechanism. The frame includes a pair of substantially horizontally oriented base legs and an upright portion coupled to and extending generally upwardly from the base legs. The seat assembly pivotally mounts to the upright portion and includes a seat platform, a pair of seat support legs generally extending from the seat platform, and a seat handle extending between the seat support legs. The locking mechanism is provided for releasably securing the seat assembly in either a seated position or an upright position. In example forms, each base leg includes a first fixed portion and a second rotatable portion. The first fixed portion generally extends along a horizontal axis that is positioned horizontally and transverse relative to the upright portion, and the second rotatable portion is generally rotatable about the horizontal axis. In one form, the second rotatable portion includes a first linear portion and a second linear portion that are generally laterally offset from each other and connected therebetween by a radiused portion. The first linear portion is generally rotatably mounted to the first fixed portion such that the second linear portion can be selectively positioned interiorly or exteriorly of the horizontal axis. Preferably, the second linear portions are positioned interiorly of the horizontal axis when the walker is in the riding mode and the seat assembly is in the seated position, and the second linear portions are positioned exteriorly of the horizontal axis when the walker is in the walking mode and the seat assembly is in the upright position.

In still another aspect, the invention relates to a walker including a frame and a seat. The frame includes a pair of base legs and an upright portion coupled to the base legs, and the seat is pivotally coupled to the upright portion. Preferably, each base leg is selectively adjustable to widen or lessen the distance therebetween. In example forms, a locking mechanism is provided for releasably securing the seat in either a seated position or an upright position. Preferably, the base legs are positionable to provide a minimum distance therebetween when the seat assembly is in the seated position, and the base legs are repositionable to provide a maximum distance therebetween when the seat is in the upright position. In example forms, at least one of the base legs includes a first portion and a second portion wherein the first portion is fixedly engaged with the upright portion and the second portion is rotatable relative to the first portion. Optionally, a locking mechanism is provided for selectively permitting rotation of the second rotatable portion relative to the first fixed portion. In an example form, the second rotatable portion can be selectively positioned in at least a first and a second angular position, the first angular position being about 180° in either of the clockwise or counter-clockwise directions from the second angular position.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Generally described, the present invention relates to a convertible walker/rider that is convertible between a walking mode and a riding mode. In the riding mode, the convertible walker is preferably configured for movement across a support surface and provides for supporting a child in the seated orientation; and in the walking mode, the convertible walker preferably provides for allowing the child to grasp portions thereof to support themselves during walking and facilitate pushing and/or pulling the convertible walker across the support surface. Preferably, at least one manually releasable locking mechanism is provided for permitting portions of the convertible walker to be reconfigurable by hand, allowing the walker to readily and easily convert between the walking and riding modes without the need for tools or complex disassembly and reassembly.

Figure 1:
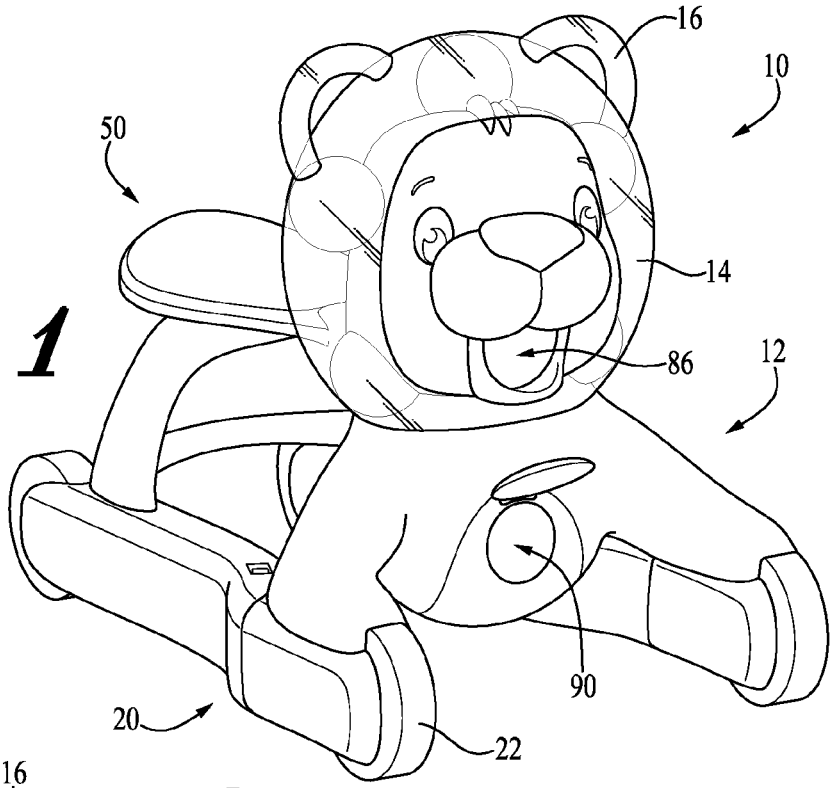
FIG. 1 is a front perspective view of a convertible walker/rider in a riding mode according to an example embodiment of the present invention.
Figure 2:
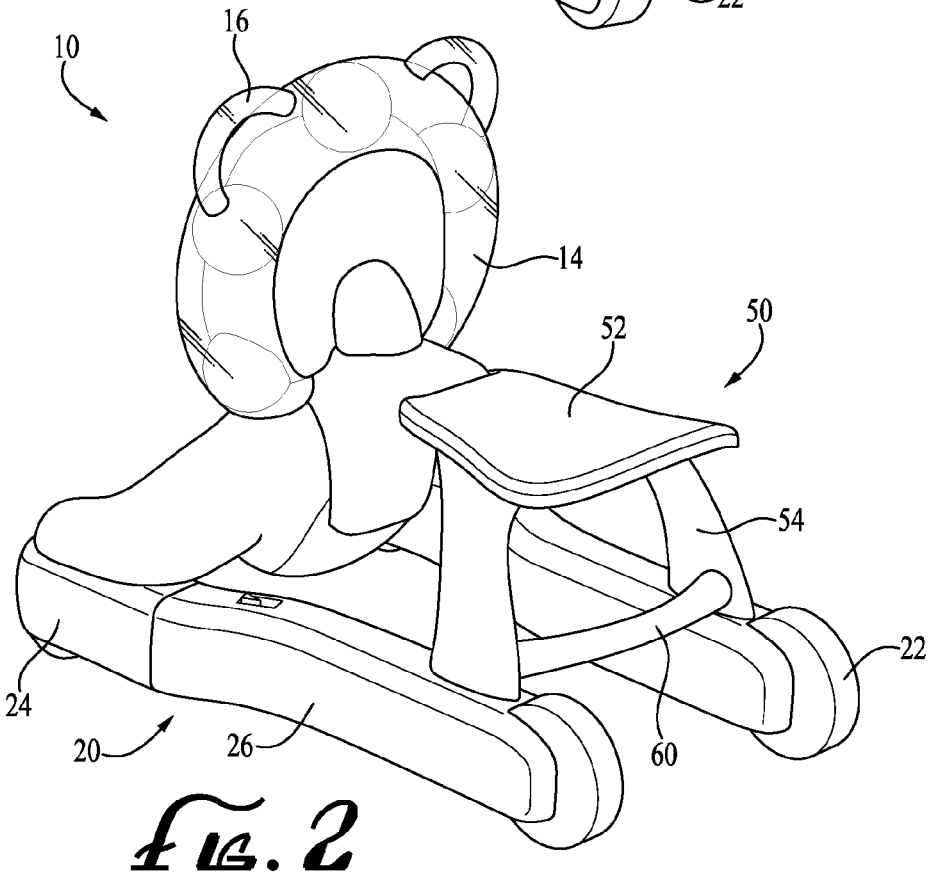
FIG. 2 is a rear perspective view of the convertible walker/rider of FIG. 1.
Figure 3:
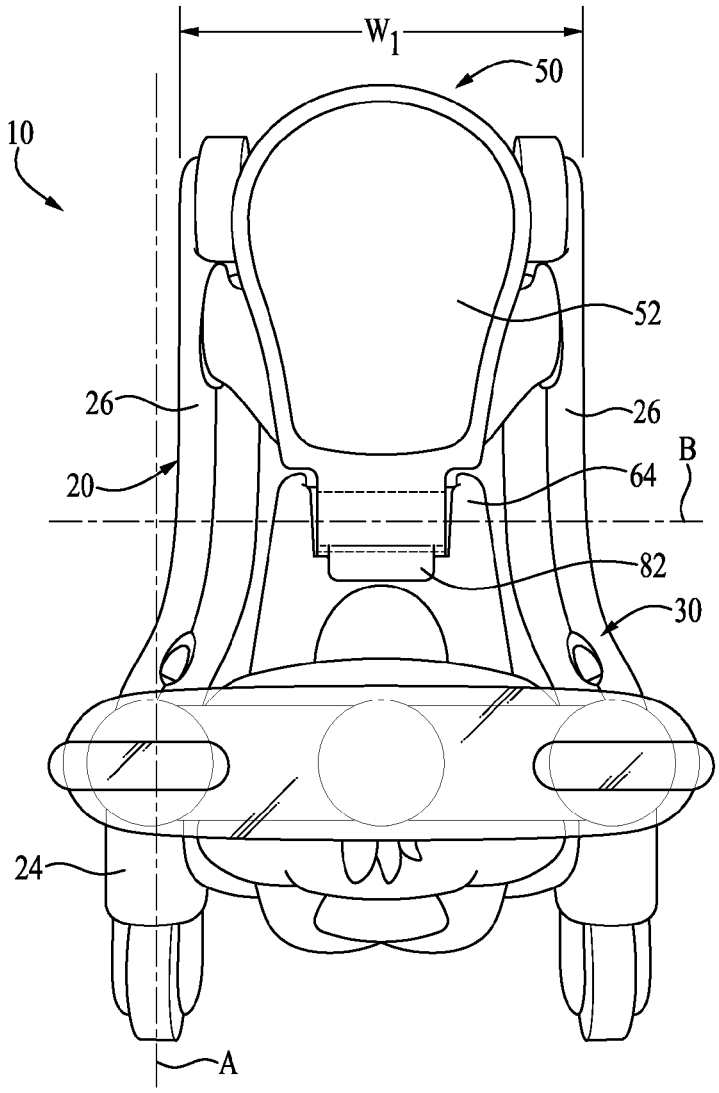
FIG. 3 is a top view of the convertible walker/rider of FIG. 1.

With reference now to the drawing figures, wherein like reference numbers represent corresponding parts throughout the several views, FIGS. 1-3 show a convertible walker 10 in the riding mode, according to an example embodiment of the present invention. In example forms, the walker 10 comprises a frame 12 configured for movement across a support surface (e.g. a floor) and a seat assembly 50 for supporting a child in a seated orientation. The frame 12 can include rolling, sliding, or gliding means to facilitate the movement of the walker 10 across the support surface. For example, the walker 10 can include a plurality of wheels 22 that allow the walker to roll across a support surface. The wheels 22 can be single-directional, as shown in FIG. 1, or alternatively can be multi-directional as for example by provision of casters and/or a steering mechanism. Preferably, the walker 10 includes one or more grips 16 that the child can grasp while seated on the seat assembly 50 in riding mode. The walker 10 can be formed to resemble an animal, character, car, or another child-appropriate theme. In one example form, the grips 16 are formed to resemble the ear portions of a baby lion cub.

The frame 12 generally comprises a pair of substantially horizontally oriented base legs 20 and an upright portion 14 coupled to and extending generally upwardly from the base legs 20. In one example form, wheels 22 are coupled to both the front and back ends of each base leg 20. In other forms, no wheels or multi-directional wheels may be utilized, for example wherein one or more of the leg portions can comprise ski-like members, rollers, sliders, or other mechanisms for traversing a support surface. Optionally, the base legs 20 are configured for movement across the support surface.

In one example form, the base legs 20 are generally formed from to two individual leg portions 24, 26, and the first leg portion 24 is generally coupled or fixedly-engaged to the upright portion 14 such that it extends generally horizontally and transverse therefrom (see horizontal axis A, FIG. 3). Preferably, the second leg portion 26 is pivotally or rotationally coupled to the first leg portion 24 for selective pivotal or rotational movement about axis A to provide alternative positioning or width spacing of the second leg portion 26 according to the mode the walker 10 is being used in (e.g., riding/walking, see FIGS. 3, 8). For example, the second leg portion 26 preferably comprises first and second linear portions that are generally laterally offset from each other and connected therebetween by a radiused, curved or offset portion. Generally, the first linear portion is axially aligned or collinear with axis A of the first portion 24 and the second linear portion is generally laterally offset or inwardly bent from the first linear portion and positioned within or interiorly of axis A.

As shown in FIG. 3, the distance between the two second linear portions thereof is defined by a width $W_1$. The width $W_1$ is generally defined between the outermost surfaces or edges of the second linear portions. Optionally, the first and second portions of the second leg portion 26 can be shaped, angled, formed, etc. as desired. For example, the base legs 20 can preferably be curved, stepped, bent, angled inwardly or otherwise provide a narrower distance therebetween such that portions of the seat assembly 50 can removably engage at least one of the base legs 20 to provide for supporting the seat assembly 50 in the riding mode.

Figure 4:
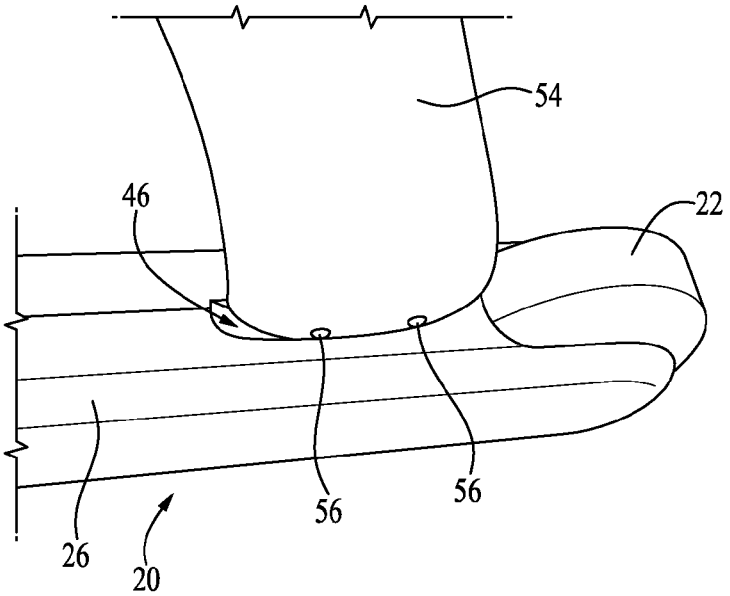
FIG. 4 is perspective view of a portion of the base legs and the seat support legs of the convertible walker/rider of FIG. 1, showing the interengagement therebetween.

The seat assembly 50 generally comprises a seat platform 52, a pair of seat support legs 54 generally extending from the seat platform 52, and a seat handle 60 extending between the seat support legs 54. Preferably, the seat assembly 50 is pivotally mounted to the upright portion 14 of the walker 10 such that the pivotal motion thereof allows the walker to be convertible between the walking and riding modes (see FIGS. 5-6). As depicted in FIGS. 1-3, the seat assembly 50 is in the down or seated position. Preferably, the second leg portions 26 of each base leg 20 comprise a recess 46 for receiving, supporting and/or coupling the free ends of the support legs 54 thereto (see FIG. 4). In preferred example embodiments, the legs 54 comprise one or more detents 56 for providing a substantially strong, removable coupling engagement with the recesses 46. The seat platform 52 generally comprises an upper seating surface upon which a child rider may sit, and a lower seatback surface opposite the upper seating surface to which a walking handle or seat handle is mounted.

Figure 5:
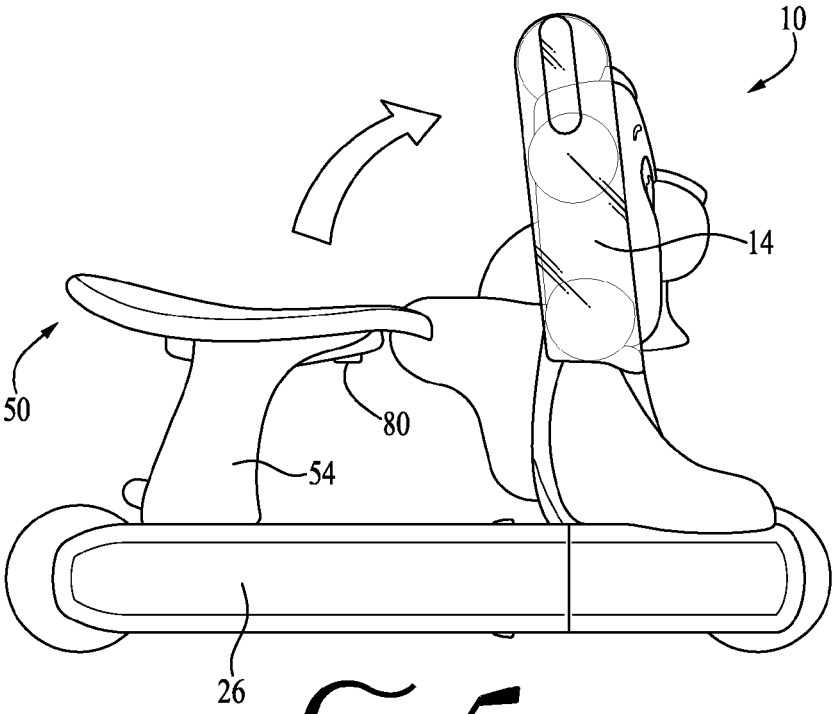
FIG. 5 is a side vide of the convertible walker/rider of FIG. 1.
Figure 6:
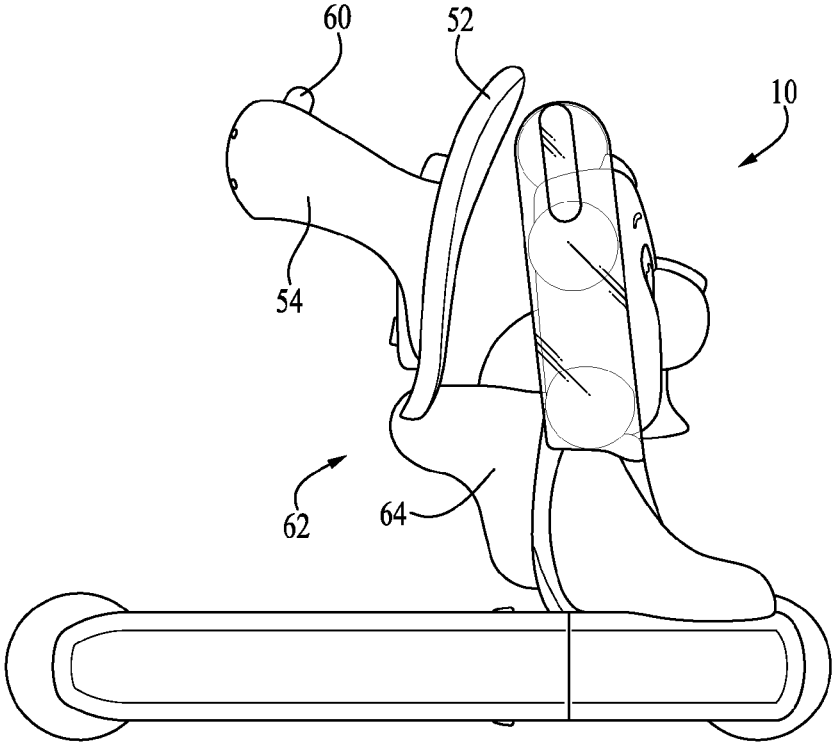
FIG. 6 is a side view of the convertible walker/rider in a walking mode according to another example embodiment of the present invention.
Figure 7:
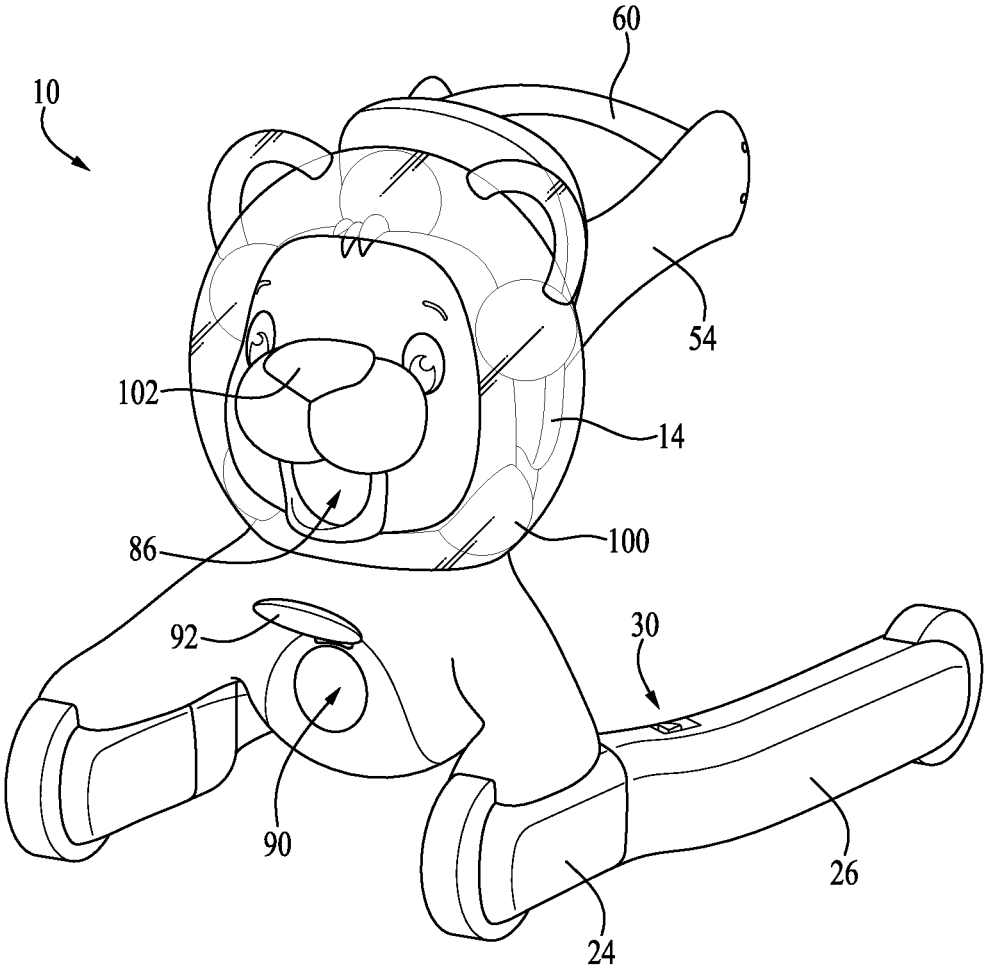
FIG. 7 is a front perspective view of the convertible walker/rider of FIG. 6.
Figure 8:
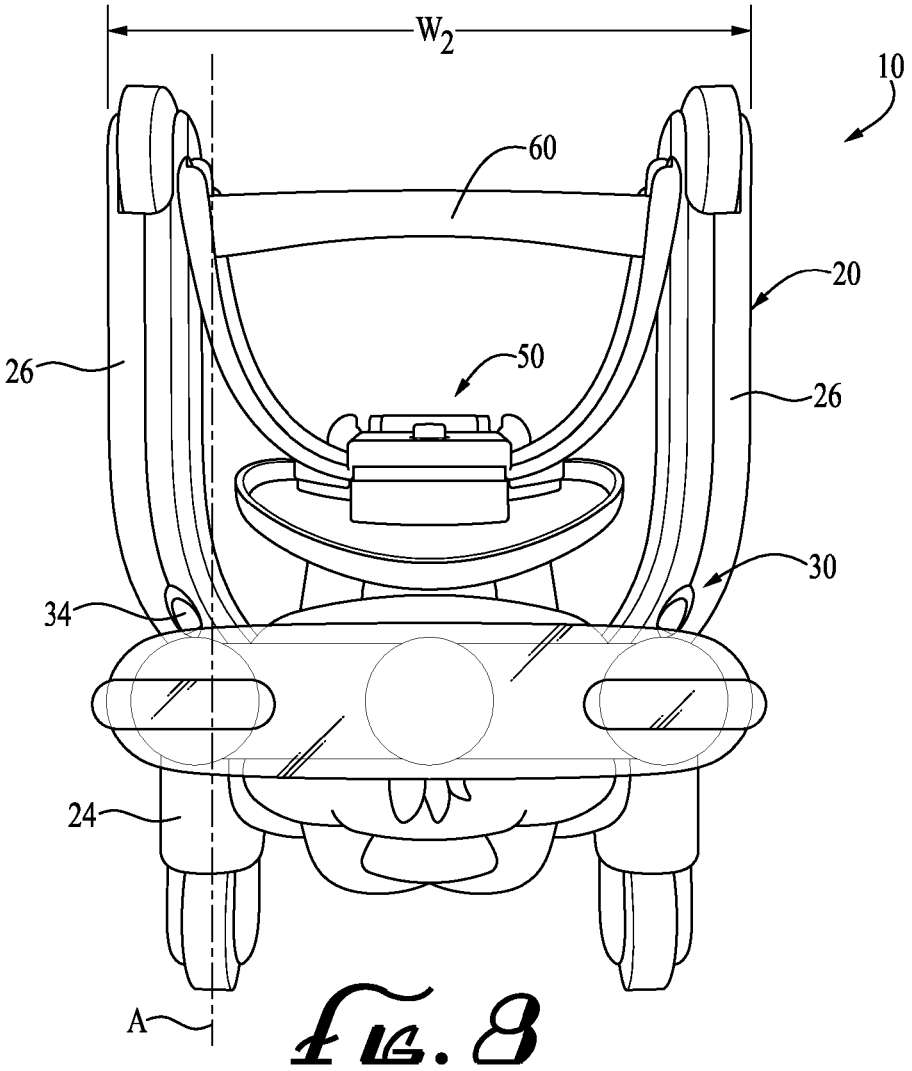
FIG. 8 is a top view of the convertible walker/rider of FIG. 6.

FIGS. 6-8 show the convertible walker 10 in the walking mode. As shown in FIGS. 5-6, the seat assembly 50 is pivoted about 90° upward in the clockwise direction from the seated position to an upright position (see directional arrow in FIG. 5). The indentions 56 are preferably disengaged from the recesses 46 of the second portions 26 and the seat handle 60 is generally positioned to allow the child to grasp portions thereof for pushing and/or pulling the walker 10 across the support surface. In one form, as will be described below, the seat assembly 50 is pivotally coupled to an arm 64 of a seat locking mechanism 62 that generally extends from the upright portion 14. The seat locking mechanism 62 preferably supports and allows for selective pivotable positioning of the seat assembly 50 by actuation of a tab 80. The pivotal movement of the seat assembly 50 is provided along an axis B that is generally transverse axis A (see FIG. 3). Optionally, the seat assembly can pivot along an axis that is generally parallel to axis A, or may be configured to pivot about another axis that is oriented as desired. After the seat assembly 50 has been pivoted and positioned in the upright position, the second leg portions 26 can be pivoted relative to the first leg portions 24 to provide for a greater width or widened stance between the two second linear portions of the second leg portions 26, for example, such that the child can stand and walk while pushing the walker 10. As shown in FIG. 8, the second leg portions 26 are positioned such that the second linear portions thereof are generally laterally offset outside or exteriorly of axis A to define a width $W_2$ therebetween, which is preferably greater or wider than the width $W_1$. As similarly described above, the width $W_2$ is generally defined between the outermost surfaces or edges of the second linear portions.

Figure 9:
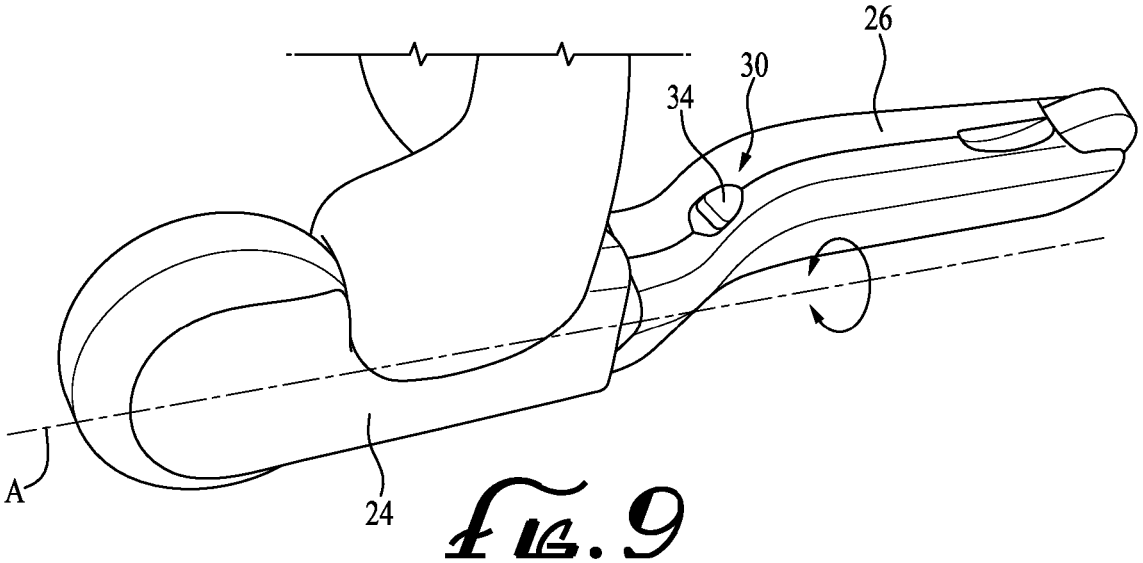
FIG. 9 is a perspective view of a portion of the convertible walker/rider of FIG. 6, showing a second portion of a base leg pivoting relative to a first portion of the base leg.
Figure 10:
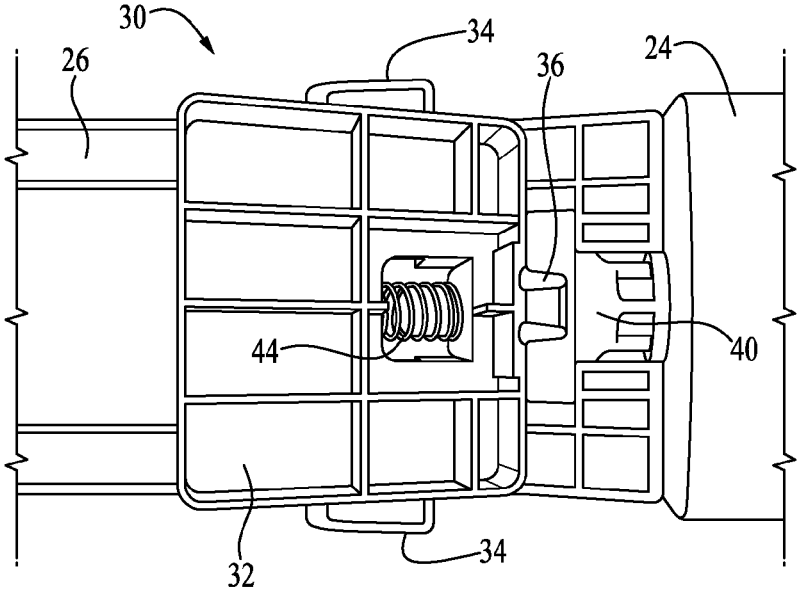
FIG. 10 is a front view of a locking mechanism of the base leg, showing the locking mechanism in a locked position.
Figure 11:
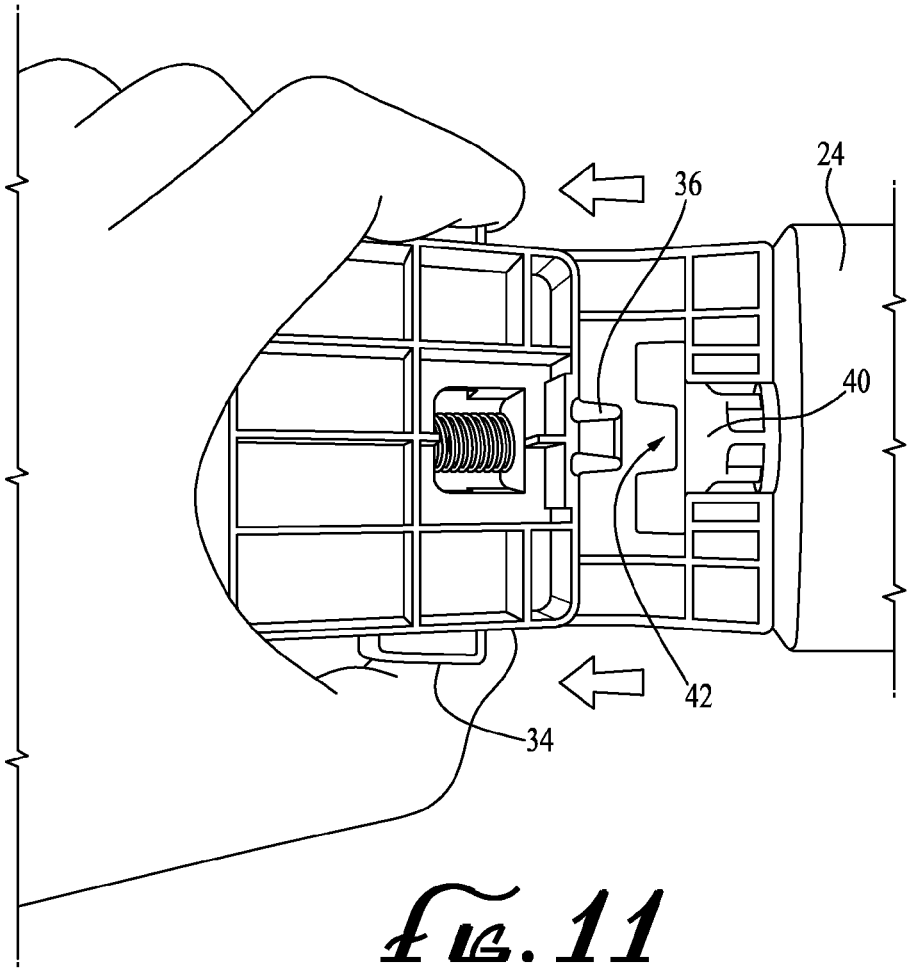
FIG. 11 is a front view of the locking mechanism of FIG. 10, showing the locking mechanism in an unlocked position.

As shown in FIGS. 9-11, a leg locking mechanism 30 is provided on each of the second leg portions 26 near the first linear portions (e.g., adjacent the pivotal connection therebetween). Preferably, the locking mechanism 30 comprises a slider 32 having a trigger 34 and a projection 36 for engagement with a groove 42 of a pinion 40. The pinion 40 is preferably axially aligned with axis A and coupled to each of the first leg portions 24 such that the first linear portions of the second leg portions 26 are rotatably engaged thereon. In one example form, the pinion 40 is generally T-shaped such that the first linear portion can be engaged therewith to permit rotational or twisting reconfiguration of the second leg portion 26 relative to the first leg portion. A biasing spring 44 is coupled between the slider 32 and a portion of the second leg portion 26 to bias the slider 32 against the pinion 40, which causes the projection 36 to interengage with the groove 42 of the pinion 40, thereby restricting pivotal motion of the second leg portion 26 relative to the first leg portion 24. As shown in FIGS. 9 and 11, the trigger 34 extends from the second leg portion 26 to provide for manual actuation thereof such that the projection 36 can be disengaged from the groove 42 to permit the second leg portion 26 to pivot about axis A relative to the first leg portion 24. In example forms, the projection 36 and groove 42 are generally oriented to extend along a horizontal axis that is generally planar with axis A such that interengagement therebetween can be provided for about every 180° of rotation of the second leg portion 26. Thus, the second leg portion 26 preferably can be manually repositioned or reconfigured into at least two angular positions, for example, a first angular position corresponding to width $W_1$ and a second angular position corresponding to width $W_2$. In example forms, when the second leg portions 26 are in the narrow width $W_1$ (see FIG. 3), and it is desired to provide a wider width $W_2$, the triggers 34 are manually actuated (disengaging the projections 36 from the grooves 42) and each of the second leg portions 26 are generally rotated about 180° relative to the first leg portions 24. The trigger 34 can then be released to allow for interengeagment between the projection 36 and the groove 42, which maintains the second leg portion 26 in the desired angular position. Preferably the leg portions remain connected during the range of motion, allowing reconfiguration without disassembly, and without the need for tools. Optionally, other interengagement members, locking mechanisms, etc. may be provided to allow for selective rotation and positioning of the second leg members 26 as desired. Optionally, the locking mechanism 30 of each base leg 20 can be configured to provide the second leg portions 26 with three or more angular positions.

In optional example embodiments, the base legs 20 or second leg portions 26 may be configured to selectively move or pivot as desired to provide a narrowed stance or minimum distance therebetween and a widened stance or maximum distance therebetween. In one form, the base legs 20 or a portion thereof may pivot about an axis that is generally vertical or substantially planar with the upright portion 14. In another form, the base legs 20 or portions thereof can be configured to traverse side-to-side, front-to-back, and/or up-and-down, and optionally in combination with one or more pivotal movements, to provide for selective adjustability of the width between the base legs, for example, to allow for the legs 20 to be positioned according to the riding or walking mode.

Figure 12:
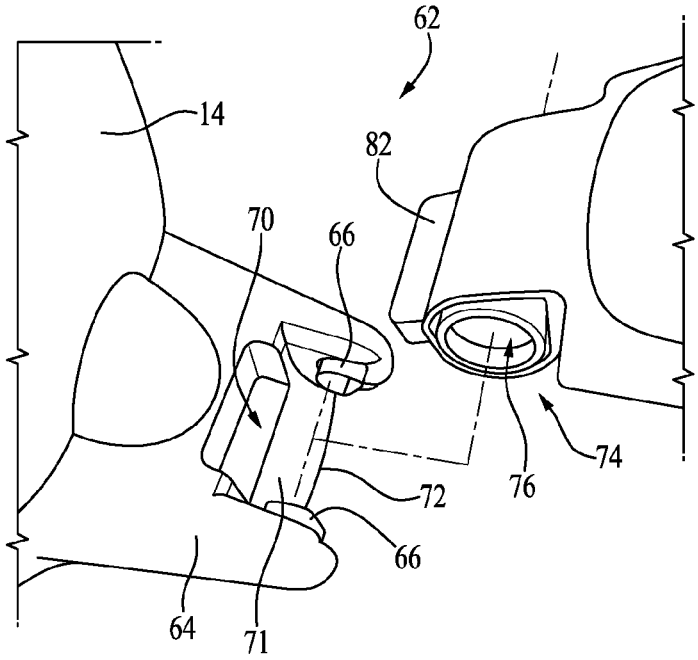
FIG. 12 is an exploded perspective view of a portion of the convertible walker/rider of FIG. 7, showing the pivotal engagement between a seat assembly and a locking mechanism for use therewith.
Figure 13:
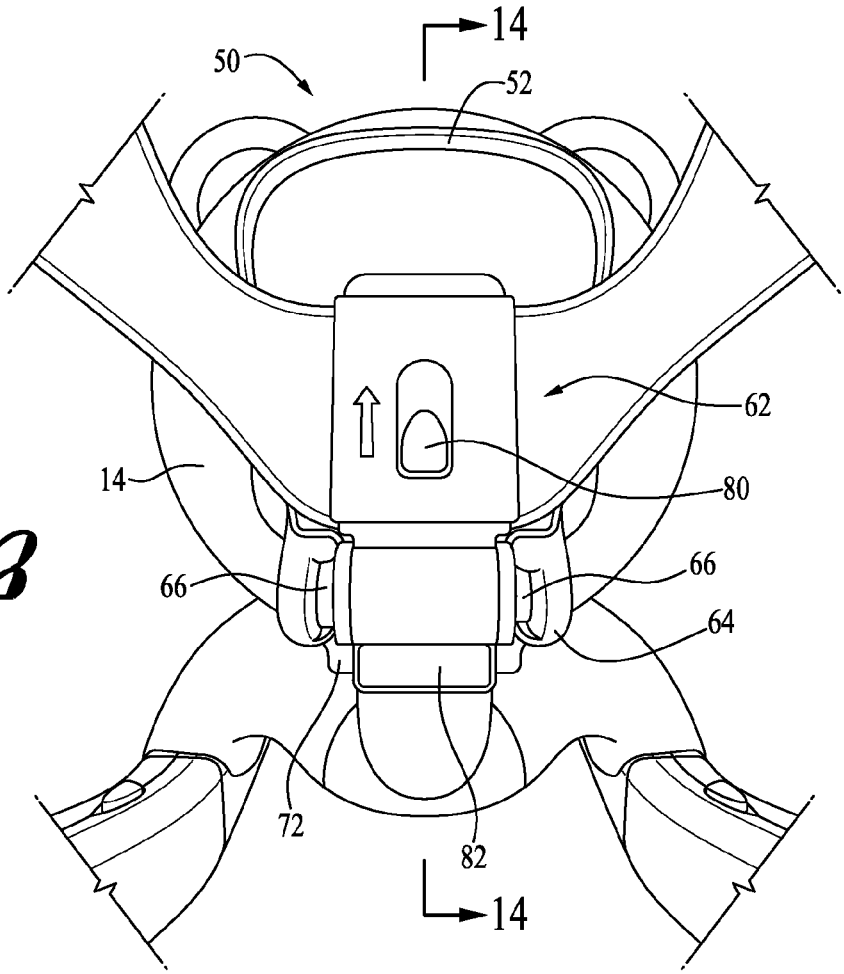
FIG. 13 is a rear view of the convertible walker/rider of FIG. 7, showing the locking mechanism of the seat assembly in greater detail.
Figure 14:
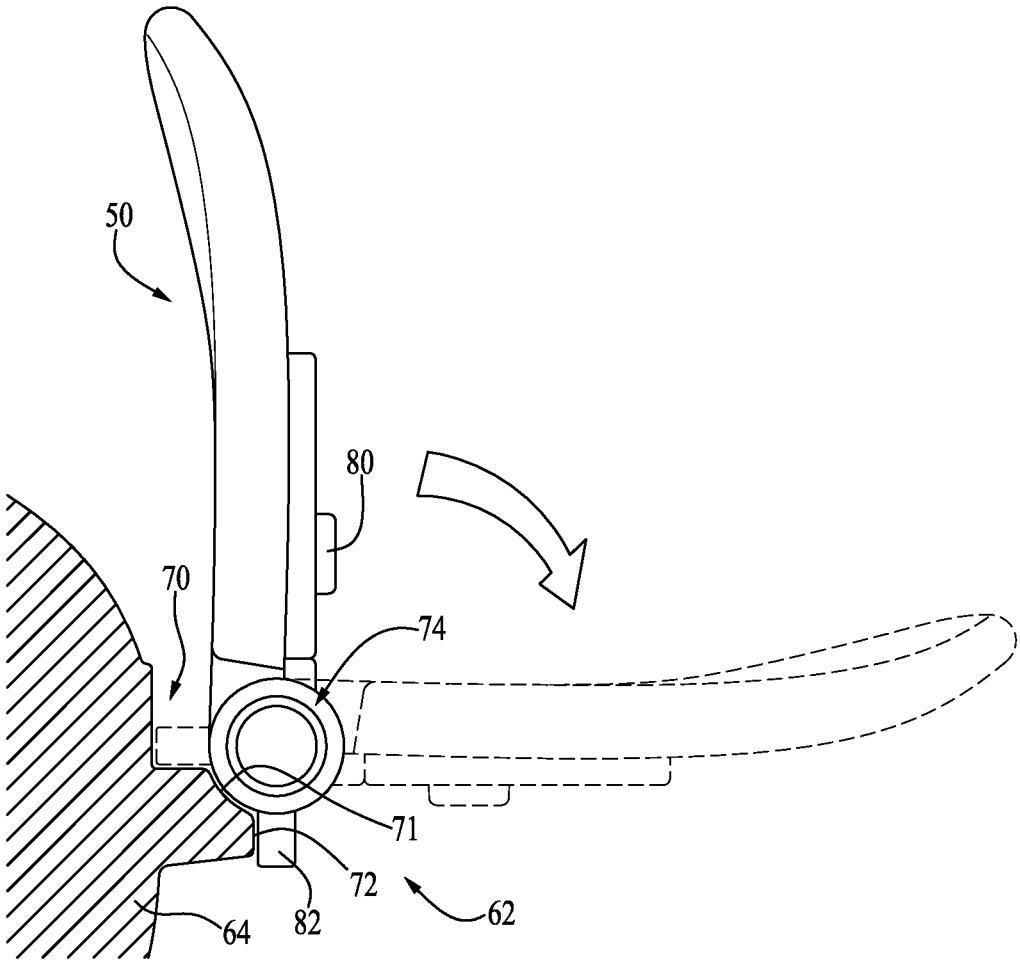
FIG. 14 is a cross-sectional view of the locking mechanism of FIG. 13 taken along line 14-14, showing the engagement of the locking mechanism and positioning of the seat assembly in both the riding and walking modes.

FIGS. 12-14 show the seat locking mechanism 62 in greater detail. Preferably, the locking mechanism 62 is provided to releasably secure the seat assembly 50 in either of the seated or upright positions. As shown in FIG. 12, the arm 64 extending from the upright portion 14 generally comprises a plurality of interengagement features for permitting the seat assembly 50 to selectively pivot between the seated position and the upright position. The arm 64 preferably comprises a pair of inwardly extending axle pins 66, a recess 70 and an edge surface 72. And, the seat assembly 50 preferably comprises a pivot 74 defining an opening 76, a tab 80, a tongue 82, and a biasing member for biasing the tongue 82 outwardly. Preferably, the axle pins 66 are configured to engage the opening 76 of the pivot 74 to allow for the seat assembly 50 to pivot about the axle pins 66 (e.g., about axis B, see FIG. 3). Optionally, the axle pins or pivot tabs 66 and their corresponding openings or receivers 76 may be asymmetrical, for example with the left-side pivot pin and opening being larger than the right-side pivot pin and opening (or vice-versa), to prevent incorrect assembly by permitting attachment only in the intended orientation and preventing engagement of one side's pivot pin with the other side's opening.

As depicted in FIGS. 13-14, the seat assembly 50 is in the upright position and the tongue 82 is biased outwardly and adjacent the end surface 72 of the arm 64 to prevent the seat assembly 50 from pivoting to the seated position. Preferably, manual actuation of the tab 80 (see arrow) causes the tongue 82 to retract within the seat assembly 50 such that the seat assembly 50 can be pivoted to the seated position. Generally, the tab 80 is held in the actuated position until the seat assembly 50 is pivoted about 5°-10°, which allows for the tongue 82 to pass the end surface 72, and the tab can then be released to move along a transitioning ramp 71 until extending within the recess 70. Optionally, the tab 80 is held until the seat assembly 50 reaches the seated position, and then released so that the tongue 82 engages the recess 70. Preferably, the engagement of the tongue 82 with the recess 70 prevents the seat assembly 50 from pivoting to the upright position, for example when an upward force is applied to the seat assembly 50. Optionally, other locking mechanisms including interengaging members, teeth, clips, snaps, hooks, fingers, or other retractable members can be provided as desired to provide for releasably securing the seat assembly 50 in either of the seated or upright positions. Optionally, the seat assembly 50 and/or locking mechanism 62 can be configured to provide for positioning the seat assembly in one or more additional angular positions between the seated position and the upright position, for example, to provide height adjustability to the handle 60. Preferably, the seat assembly 50 remains connected to the frame 12 throughout the range of motion, allowing reconfiguration without disassembly, and is manually operable without the need for tools.

In additional example embodiments, the walker 10 can include an activity center with which the child can interact in a third, play mode. For example, the activity center can comprise a ball slide. As shown in FIGS. 1 and 7, the ball slide includes a first opening 86 through which the child can feed toy balls. The toy balls roll down an internal slide and exit out of a second opening 90. Some example embodiments can include wheel brakes or other means for inhibiting movement of the walker 10 while the walker 10 is in the play mode. Optionally, a pivotal door or flange 92 is provided near the second opening 90 for preventing the toy balls from exiting the second opening 90, for example such that the balls can be stored within the internal slide when not in use. Further optional, the walker 10 may comprise one or more electronic mechanisms and/or sound devices for providing moving entertaining objects, projecting audible sound patterns via a speaker or other audio output, and/or one or more push-buttons to trigger or activate the electronic mechanisms and/or sound devices. Optionally, one or more batteries may be provided for powering the electronic mechanisms and/or sound devices. In one example form, an electronic mechanism is provided within a portion of the upright portion 14 such that a plurality of balls or spherical objects 100 move in a circular path around the upright portion 14. Optionally, a push-button 102 is provided to actuate movement of the objects 100 and cause the speaker to project an audible sound.

While the invention has been described with reference to preferred and example embodiments, it will be understood by those skilled in the art that a variety of modifications, additions and deletions are within the scope of the invention, as defined by the following claims.

What is claimed is:

1. A convertible walker/rider comprising:

a frame comprising a pair of substantially horizontally extending base legs and an upright portion coupled to and extending generally upwardly from the base legs; and a seat assembly pivotally mounted to the upright portion, the seat assembly comprising a seat platform, a pair of seat support legs generally extending from the seat platform, and a seat handle extending between the seat support legs, wherein the seat support legs each have a lower portion that engages a respective one of the base legs to support the seat platform, and wherein the seat handle is a cross-member handgrip with opposing ends attached to the lower portions of the seat support legs.

2. The convertible walker/rider of claim 1, wherein the seat assembly is positionable in either a seated position for operating the convertible walker in a riding mode or in an upright position for operating the convertible walker in a walking mode.

3. The convertible walker/rider of claim 2, further comprising a seat locking mechanism for selectively securing the seat assembly in either of the seated or upright positions.

4. The convertible walker/rider of claim 3, wherein the seat locking mechanism comprises an arm extending from the upright portion and having a pair of inwardly extending axle pins for engaging the seat assembly and allowing for pivotal motion thereof.

5. The convertible walker/rider of claim 4, wherein the arm further comprises a recess and an edge surface, and wherein the seat locking mechanism further comprises a outwardly-biased tongue extending from a portion of the seat assembly for selective engagement with the recess and the edge surface.

6. The convertible walker/rider of claim 5, and wherein a tab is provided for permitting actuation of the tongue such that the tongue can be moved against the bias and within the seat assembly.

7. The convertible walker/rider of claim 6, wherein the tongue is engaged with the recess when the seat assembly is in the seated position.

8. The convertible walker/rider of claim 6, wherein the tongue is engaged with the edge surface when the seat assembly is in the upright position.

9. The convertible walker/rider of claim 1, wherein the base legs are selectively reconfigurable to increase or decrease the distance therebetween.

10. The convertible walker/rider of claim 9, wherein the base legs are positionable to provide a reduced distance therebetween when the seat assembly is in the seated position.

11. The convertible walker/rider of claim 9, wherein the base legs are positionable to provide an increased distance therebetween when the seat is in the upright position.

12. A children's convertible walker, the walker being convertible between a riding mode and a walking mode, the children's convertible walker comprising:

a frame comprising a pair of substantially horizontally oriented base legs and an upright portion coupled to and extending generally upwardly from the base legs, wherein the upright portion is in a fixed and upright relationship relative to the base legs in both the walker mode and the rider mode;

a seat assembly pivotally mounted to the upright portion, the seat assembly comprising a seat platform, a pair of seat support legs generally extending from the seat platform, and a seat handle extending between the seat support legs; and a seat locking mechanism for releasably securing the seat assembly in either a seated position or an upright position; and wherein the seat support legs each have a lower portion that engages a respective one of the base legs to support the seat platform, and wherein the seat handle is a cross-member handgrip attached to the lower portions of the seat support legs.

13. The children's convertible walker of claim 12, wherein each base leg comprises a first fixed portion and a second rotatable portion, the first fixed portion generally extending along a horizontal axis that is positioned horizontally and transverse relative to the upright portion, and the second rotatable portion generally rotatable about the horizontal axis.

14. The children's convertible walker of claim 13, wherein the second rotatable portion comprises a first linear portion and a second linear portion that are generally laterally offset from each other and connected therebetween by a radiused portion.

15. The children's convertible walker of claim 14, wherein the first linear portion is rotatably mounted to the first fixed portion such that the second linear portion can be selectively positioned interiorly or exteriorly of the horizontal axis.

16. The children's convertible walker of claim 15, wherein the second linear portions are positioned interiorly of the horizontal axis when the walker is in the riding mode and the seat assembly is in the seated position.

17. The children's convertible walker of claim 15, wherein the second linear portions are positioned exteriorly of the horizontal axis when the walker is in the walking mode and the seat assembly is in the upright position.

18. The children's convertible walker of claim 15, further comprising a locking mechanism positioned near the first linear portion of the second rotatable portion for selectively permitting rotation of the second rotatable portion about the horizontal axis relative to the first fixed portion.

19. The children's convertible walker of claim 18, wherein the second rotatable portions can be selectively positioned at a first and a second angular position, the first angular position being about 180° in either of the clockwise or counter-clockwise directions from the second angular position.

20. The children's convertible walker of claim 16, further comprising a recess formed within each of the second rotatable portions and positioned such that the leg portions of the seat assembly can removably engage the recesses when the second linear portions are positioned interiorly of the horizontal axis and when the seat assembly is in the seated position.

21. A walker comprising:

a frame comprising a pair of base legs and an upright portion coupled to the base legs, each base leg being selectively reconfigurable between at least first and second configurations to widen or lessen the distance therebetween, wherein at least one of the base legs comprises a first portion and a second portion, the first portion being fixedly engaged with the upright portion, the second portion being movable relative to the first portion between the first and second configurations, and the second portion including at least one wheel that supports the base leg on a support surface in the first and second configurations; and a seat pivotally coupled to the upright portion of the frame.

22. The walker of claim 21, further comprising a seat locking mechanism for releasably securing the seat in either a seated position or an upright position.

23. The walker of claim 22, wherein the base legs are positioned to provide a minimum distance therebetween when the seat assembly is in the seated position.

24. The walker of claim 22, wherein the base legs are positioned to provide a maximum distance therebetween when the seat is in the upright position.

25. The walker of claim 21, wherein the second portion is rotatable relative to the first portion.

26. The walker of claim 25, further comprising a locking mechanism for selectively permitting rotation of the second rotatable portion relative to the first fixed portion.

27. The walker of claim 26, wherein the second rotatable portion can be selectively positioned in at least a first and a second angular position in the respective first and second configurations, the first angular position being about 180° in either of the clockwise or counter-clockwise directions from the second angular position.

28. A walker/rider comprising:

a frame comprising a pair of base legs and an upright portion, each of the base legs comprising at least one wheel, the upright portion in a fixed upright position relative to the base legs;

a seat/handle assembly pivotally coupled to the upright portion of the frame, movable between a first position and a second position, and including a seat platform portion and a handgrip portion;

the walker/rider being convertible between a walker mode and a rider mode, wherein in the walker mode the seat/handle assembly is in the first position in a handle configuration with the handgrip portion thereof accessible to a user standing between the pair of base legs, wherein in the rider mode the seat/handle assembly is in the second position in a seat configuration with the seat platform portion thereof accessible to support the user seated generally above the pair of base legs, and wherein the frame upright portion is in the fixed upright position in both the walker mode and the rider mode.

29. The walker/rider of claim 28, wherein the pair of base legs are convertible between a first orientation and a second orientation, the first orientation corresponding to the walker mode of the walker/rider wherein the user is standing between the pair of base legs, and the second orientation corresponding to the rider mode of the walker rider wherein the user is seated above the pair of base legs.

* * * * *